US005742125A

United States Patent [19]

Ruigrok

[11] Patent Number: 5,742,125

[45] Date of Patent: Apr. 21, 1998

[54] HIGH-PRESSURE DISCHARGE LAMP WITH TORSIONALLY WOUND ELECTRODE STRUCTURE

[75] Inventor: Jacobus L. J. Ruigrok, Eindhoven, Netherlands

[73] Assignee: U.S. Philips Corporation, New York, N.Y.

[21] Appl. No.: 742,054

[22] Filed: Oct. 31, 1996

[30] Foreign Application Priority Data

Nov. 2, 1995 [EP] European Pat. Off. ..... 95202963

[51] Int. Cl.[6] ..... H01J 61/06; H01J 61/073

[52] U.S. Cl. ..... 313/628; 313/631; 445/46; 445/51; 140/71.5

[58] Field of Search ..... 313/628, 631, 313/633, 344, 25, 575, 576; 445/46, 50, 51; 140/71.5

[56] References Cited

U.S. PATENT DOCUMENTS

| | | | |
|---|---|---|---|
| 1,952,841 | 3/1934 | Coe | 80/14 |
| 2,687,489 | 8/1954 | Anderson, Jr. et al. | 313/344 |
| 3,132,409 | 5/1964 | Freeman | 313/344 |
| 3,170,081 | 2/1965 | Rokosz | 313/631 |
| 4,150,317 | 4/1979 | Laska et al. | 313/631 |
| 4,559,473 | 12/1985 | McVey | 313/631 |
| 4,783,611 | 11/1988 | Vogels et al. | 313/628 |
| 4,847,534 | 7/1989 | Der Kinderen | 313/628 |
| 4,929,863 | 5/1990 | Verbeek et al. | 313/113 |
| 4,952,841 | 8/1990 | Coomans et al. | 313/631 |
| 5,001,397 | 3/1991 | Der Kinderen | 313/628 |
| 5,357,167 | 10/1994 | Mathews et al. | 313/344 |

FOREIGN PATENT DOCUMENTS

| | | | |
|---|---|---|---|
| 2043331 | 10/1980 | United Kingdom | H01J 61/04 |

*Primary Examiner*—Michael Horabik
*Assistant Examiner*—Michael Day
*Attorney, Agent, or Firm*—Walter M. Egbert

[57] ABSTRACT

The high pressure discharge lamp has refractory electrodes each having a top and a winding of refractory metal wire, which has turns and is, in an area thereof remote from the top, secured to the electrode. The turns of the winding are made to have torsion. Thereby an accurately defined position with respect to the top of the electrode is obtained. The direction of the torsion is opposite to the direction of the turns, which causes neighbouring turns to press one against the other.

4 Claims, 1 Drawing Sheet

HIGH-PRESSURE DISCHARGE LAMP WITH TORSIONALLY WOUND ELECTRODE STRUCTURE

BACKGROUND OF THE INVENTION

The invention relates to a high-pressure discharge lamp provided with:

- a lamp vessel which is closed in a vacuumtight manner and which contains an ionizable filling;
- a pair of heat-resistant electrodes each with a tip in the lamp vessel and each connected to a respective current conductor which issues from the lamp vessel to the exterior,
- a winding of turns of heat-resistant metal wire being present around a free-end portion of each electrode, which winding is fixed in a location remote from the electrode tip, said turns having a winding direction.

Such a high-pressure discharge lamp is known from U.S. Pat. No. 4,952,841.

The electrode winding may have the object of realizing a desired temperature gradient during operation, or also of accommodating an emitter for reducing the work function of the electrodes.

A winding of a certain type is desired for a lamp of a certain type, i.e. a winding of one or several layers of turns, with a predetermined number of turns per layer, with wire of a chosen thickness, and with a predetermined distance to the electrode tip. Such a winding is known in detail from U.S. Pat. No. 4,929,863.

The winding may be made beforehand on a winding mandrel which has a thickness greater than the electrode, whereupon it is passed over the electrode and fixed thereon. One or several turns may be flattened for this purpose so that the winding clamps itself around the electrode, or a welded joint between electrode and winding may be made, for example a resistance weld or laser weld.

Alternatively, however, the winding may be made directly on the electrode. It is usually necessary also in this case, however, to secure the winding because winding stresses result in the turns becoming wider.

Electrodes of the type mentioned are suitable for use in high-pressure discharge lamps of various types and power ratings.

It is known from U.S. Pat. No. 5,001,397 and U.S. Pat. No. 4,783,611 to provide a knot in the winding which prevents winding stresses from making the turns wider such that the winding can shift. An additional fixation through, for example, a weld is not necessary in the case of a knotted winding. The winding is not universally applicable, however, because a knot can only be made when the winding has at least two layers of turns. The making of the winding in addition requires a complicated equipment.

The application copending U.S. application Ser. No. 08/431,881 filled May 1, 1995 not previously published describes an electrode which has deformations causing the electrode to have unround cross-sections where wire has been coiled around it. Owing to these unround cross-sections, the winding hooks itself around the electrode and the turns are incapable of widening. It was found to be difficult, however, to manufacture the electrodes in an automated process for lamps of comparatively high power ratings, above-approximately 150 W.

It was found to be a disadvantage that the distance of the electrode winding of the lamp described in the opening paragraph to the tip of the electrode is badly reproducible. The distance of the winding to the electrode tip is found to vary strongly after the lamp has been operating without the fastening of the winding to the electrode having been broken. This holds, too, in the case of lamps manufactured with windings from one batch which were accurately provided at a predetermined distance from the tips of the electrodes, for example by means of a jig, and which were fixed in a location remote from the tips. Some windings had become comparatively much, others comparatively little longer. The result is that some electrodes project with their tips comparatively little beyond the windings, others comparatively far.

Changes in the distance between the electrode tip and the winding may be ascribed to stresses in the winding caused by the winding process. Changes as such can be taken into account for each type of lamp during mounting of the winding. Fluctuations in these changes, which are found to be in fact unpredictable, cannot. Nevertheless, the distance from the winding to the electrode tip has a major influence on lamp properties, i.e. whether this distance is positive: freely projecting tip; negative: tip surrounded by winding; or nil. The distance influences inter alia (i) the stability of the discharge, for example whether the discharge arc leaps from one point to the other, which determines whether the lamp flickers, (ii) the temperature of the coldest spot in the lamp vessel, which may change the color of the generated light or the voltage drop across the lamp, and thus the light output, and (iii) lumen maintenance during lamp life.

SUMMARY OF THE INVENTION

It is an object of the invention to provide a high-pressure discharge lamp of the kind described in the opening paragraph in which the winding occupies an accurate, predetermined position on the electrode also after the lamp has been operating.

According to the invention, this object is achieved in that the turns are made with torsion in the metal wire, which torsion has a direction opposed to the winding direction of the turns, whereby adjoining turns press against one another.

Owing to the torsion in the turns, the wire has a tendency to deform such that the torsional stress in the wire becomes less. Given a torsion direction opposed to the winding direction of the wire, this manifests itself in that the distances between adjoining turns are minimized and the turns are pressed together. The winding has the tendency to become shorter, and thus thicker. This has the result that a well-defined distance to the electrode tip is retained when the winding relieves itself at operational temperature. Not only do the turns press against one another laterally, but the fact that the metal wire was wound with rotation, which introduced torsion into the turns, also has the result that grooves in the wire surface arising from the manufacture of the wire in a drawing die do not extend in axial direction along the wire but revolve around the wire at an angle to the axis.

The expression "direction of the torsion" is here understood to mean: the direction in which the free end of the wire viewed by an observer looking along the wire towards the winding mandrel has been revolved about its axis during winding: clockwise or counterclockwise. In that case, drawing lines on the wire will revolve in counterclockwise and clockwise direction, respectively, around the wire, as seen by this observer. The expression "winding direction of turns" is understood to mean: the direction in which the wire in the turns moves away from the observer in a layer of turns around the electrode.

It is noted that a high-pressure discharge lamp is known from U.S. Pat. No. 4,847,534 in which the electrodes have windings of which some turns were made with torsion in the wire. The torsion direction, however, is the same as the winding direction here. According to this document, this has the result that the winding indeed has a tendency to become longer, and thus thinner, in order to reduce torsional stresses. Such windings manufactured on a winding mandrel can be removed therefrom with difficulty only in order to pass them over a thinner electrode. Such windings when made directly on an electrode are found to result in an uncertainty as to the degree to which the winding will become longer, partly also in dependence on unintentional variations in the degree of torsion. The distance from the winding to the electrode tip is not accurately defined as a result, and the torsion is counterproductive to the object of the present invention.

In the lamp according to the invention, by contrast, the position of the winding can be determined with high accuracy, for example through assembly in a jig, while in addition the degree of torsion is of little importance in a given electrode because the turns will indeed press more strongly against one another in the case of a greater torsion, but will not lie closer together. The minimum torsion to be provided for obtaining reproducible electrodes may be readily ascertained for each type of electrode in a small test series.

Is obvious that it is immaterial to the invention in which type of high-pressure discharge lamp the electrodes are to be used. Thus, for example, the lamp vessel may be made, for example, of quartz glass or ceramic material, the ionizable filling may comprise besides rare gas also metal halides and/or mercury. The electrodes may be made, for example, from tungsten, whether or not doped with an emitter such as, for example, $Y_2O_3$, $HfO_2$, while the tip may be formed from or with the aid of a different material. The winding may in particular be made from tungsten wire. It is an advantage of the winding that it surrounds the electrode with clearance, so that it can enclose comparatively much emitter material together with the electrode when used in lamps which require such material. The winding is universal in the sense that it may comprise one, two or more layers of turns and that it may leave exposed or surround the electrode tip.

BRIEF DESCRIPTION OF THE DRAWINGS

An embodiment of the high-pressure discharge lamp according to the invention is shown in the drawing, in which.

DESCRIPTION OF THE PREFERRED EMBODIMENTS

Figure 1:
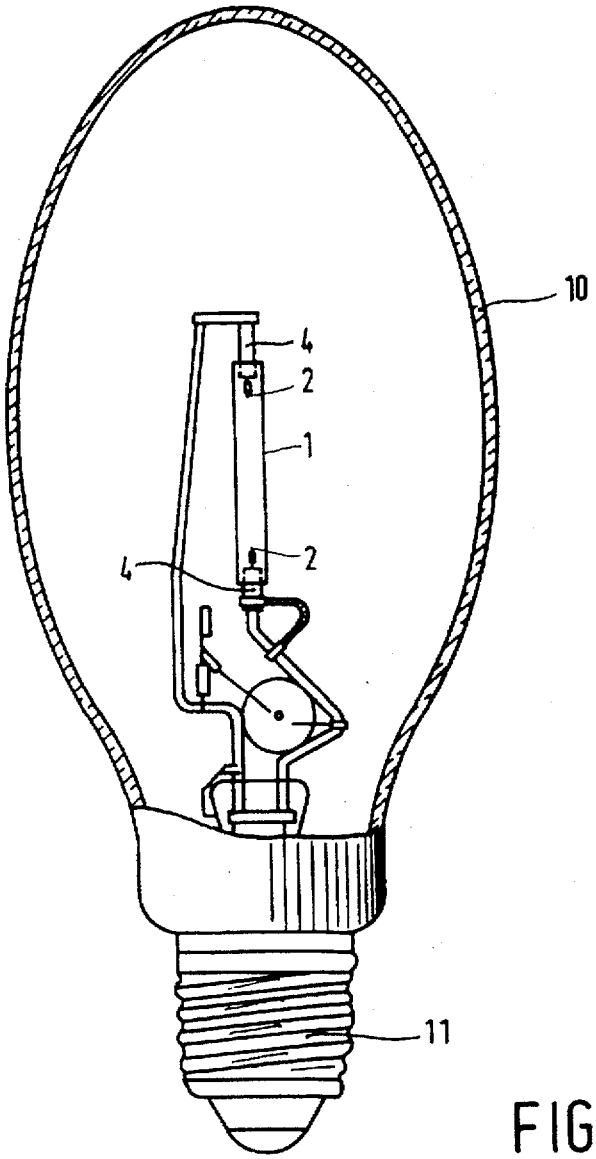
FIG. 1 shows a lamp in side elevation, partly broken away.

The high-pressure discharge lamp of FIG. 1 has a lamp vessel 1 which is closed in a vacuumtight manner, is made of ceramic material in the Figure, and is filled with an ionizable gas, for example with rare gas, mercury, and sodium. A pair of heat-resistant, or refractory, electrodes 2, substantially made of tungsten in the Figure, with respective tips 3 are arranged in the lamp vessel and connected to current conductors 4 which issue from the lamp vessel to the exterior. A winding 5 with turns 6 of heat-resistant, or refractory, metal wire, tungsten wire in the Figure, is present around a free-end portion of each electrode 2. The winding is secured with a resistance weld 9 in a location of the electrode remote from the tip. The turns have a winding direction. In FIG. 1, the lamp vessel 1 is accommodated in a closed outer envelope 10 which supports a lamp cap 11.

Figure 2:
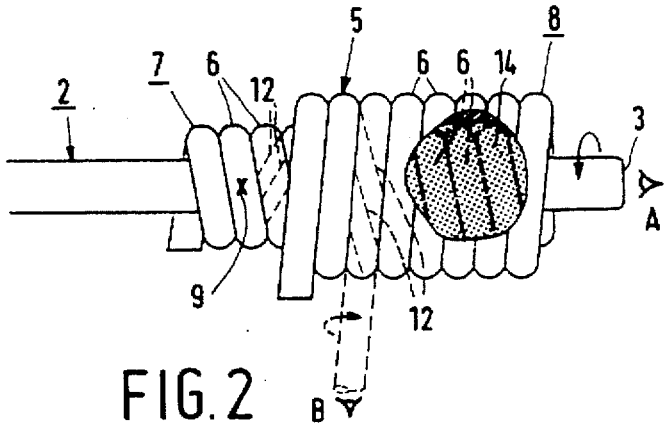
FIG. 2 shows an electrode from FIG. 1 in side elevation, partly broken away.

The turns 6 are manufactured with torsion in the metal wire, see FIG. 2, which torsion has a direction opposed to the winding direction of the turns 6. As a result, adjoining turns 6 press against one another.

The winding 5 has a first layer 7 of turns 6 which merges near the tip 3 into a second layer 8 of turns 6. Emitter 14, for example barium tungstate, is accommodated in the winding 5.

The turns 6 of the second layer 8 were made in counterclockwise direction as seen by an observer A. As seen by an observer B, the wire from which the turns were made has a torsion in clockwise direction, i.e. opposed to the winding direction. Drawing lines 6 as a result enclose an angle with the axis of the wire and revolve themselves around the wire in counterclockwise direction. The electrode was provided with emitter material in that it was immersed in a suspension so as to fill up the space between electrode and winding as well as spaces between turns, and its surface was cleaned by brushing after drying.

A winding of tungsten wire of 0.6 mm thickness was provided around an electrode of 1.2 mm diameter. The coiling wire was given a torsion of 0.040 Nm against the winding direction during winding. The winding was fixed in a jig at a predetermined distance from the tip. The windings were found to have the same distance to the tip after 100 burning hours in lamps provided with electrodes of this kind. The electrode can be manufactured in an automated process and may be used for a lamp consuming a power of approximately 400 W.

I claim:

1. A high-pressure discharge lamp comprising:

a lamp vessel which is closed in a vacuumtight manner and which contains an ionizable filling;

a pair of heat-resistant electrodes each with a tip in the lamp vessel and each connected to a respective current conductor which issues from the lamp vessel to the exterior, a winding of turns of heat-resistant metal wire being present around a free-end portion of each electrode, said winding fixed in a location remote from the electrode tip, said turns having a winding direction, wherein the turns are made with torsion in the metal wire, said torsion having a direction opposed to the winding direction of the turns, such that adjoining turns press against one another.

2. A high-pressure discharge lamp as claimed in claim 1, wherein the winding has a first layer of turns which merges adjacent the tip into a second layer of turns.

3. A high-pressure discharge lamp as claimed in claim 2, wherein an emitter is accommodated in the winding.

4. A high-pressure discharge lamp as claimed in claim 1, wherein an emitter is accommodated in the winding.

* * * * *